US006608447B2

(12) United States Patent
Ahn

(10) Patent No.: US 6,608,447 B2
(45) Date of Patent: Aug. 19, 2003

(54) PLASMA DISPLAY PANEL AND DRIVING METHOD THEREOF

(75) Inventor: Young Joon Ahn, Kumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/989,493

(22) Filed: Nov. 21, 2001

(65) Prior Publication Data

US 2002/0089292 A1 Jul. 11, 2002

(30) Foreign Application Priority Data

Jan. 10, 2001 (KR) ..... 2001-1400

(51) Int. Cl.[7] ..... G09G 3/10

(52) U.S. Cl. ..... 315/169.1; 315/169.4; 345/41; 345/42; 313/584; 313/587

(58) Field of Search ..... 315/169.4, 169.1, 315/168; 313/582, 584–587; 345/41, 42, 48, 51, 55

(56) References Cited

U.S. PATENT DOCUMENTS 6,184,848 B1 * 2/2001 Weber ..... 345/60
6,232,717 B1 * 5/2001 Oida et al. ..... 313/586
6,380,678 B1 * 4/2002 Kim ..... 313/586

* cited by examiner

*Primary Examiner*—Haissa Philogene
(74) *Attorney, Agent, or Firm*—Birch, Stewart, Kolasch & Birch, LLP

(57) ABSTRACT

A plasma display panel and a driving method thereof is adaptive for realizing high efficiency. In the plasma display panel, a sustaining electrode pair and an address electrode are included in each discharge cell. A first dielectric layer covers the sustaining electrode pair. To induce a discharge of the sustaining electrode pair, a floating electrode pair is formed parallel thereto on the first dielectric layer. A second dielectric layer and a protective film cover the floating electrode pair. Accordingly, two auxiliary electrodes are provided between the sustaining electrode pair so that when a voltage is applied to the sustaining electrode pair, the voltage is driven into the auxiliary electrodes. A primary discharge is thus induced between said auxiliary electrodes at a low voltage and therefore a long-path discharge is induced between the sustaining electrode pair at a low voltage, even though they are distanced apart from each other.

10 Claims, 5 Drawing Sheets

PLASMA DISPLAY PANEL AND DRIVING METHOD THEREOF

BACKGROUND OF THE INVENTION

1. Field of the Invention

The present invention relates to a plasma display panel that is adaptive for realizing a high efficiency. The present invention also is directed to a method of driving the plasma display panel.

2. Description of the Related Art

Recently, a plasma display panel (PDP) which is feasible in the manufacturing of a large-dimension panel has been highlighted as a flat panel display device. The PDP typically includes a three-electrode, alternating current (AC) surface discharge PDP which has three electrodes and is driven with an AC voltage as shown in FIG. 1 and FIG. 2.

Referring to FIG. 1 and FIG. 2, a discharge cell of the three-electrode, AC surface discharge PDP includes a scanning/sustaining electrode 12Y and a common sustaining electrode 12Z formed on an upper substrate 10, and an address electrode 20X formed on a lower substrate 18. On the upper substrate 10 in which the scanning/sustaining electrode 12Y is formed in parallel to the common sustaining electrode 12Z, an upper dielectric layer 14 and a protective film 16 are disposed. Wall charges generated upon plasma discharge are accumulated in the upper dielectric layer 14. The protective film 16 prevents a damage of the upper dielectric layer 14 caused by the sputtering generated during the plasma discharge and improves the emission efficiency of secondary electrons. This protective film 16 is usually made from MgO. A lower dielectric layer 22 and barrier ribs 24 are formed on the lower substrate 18 provided with the address electrode 20X, and a fluorescent material 26 is coated on the surfaces of the lower dielectric layer 22 and the barrier ribs 24. The address electrode 20X is formed in a direction crossing the scanning/sustaining electrode 12Y and the common sustaining electrode 12Z. The barrier ribs 24 are formed in parallel to the address electrode 20X to prevent an ultraviolet ray and a visible light created by the discharge from being leaked into the adjacent discharge cells. The fluorescent material 26 is excited by an ultraviolet ray generated upon plasma discharge to produce any one of red, green and blue visible light rays. An inactive gas for a gas discharge is injected into a discharge space defined between the upper/lower substrate and the barrier rib.

As shown in FIG. 3, such a discharge cell is arranged in a matrix type. In FIG. 3, the discharge cell 1 is provided at each intersection among scanning/sustaining electrode lines Y1 to Ym, common sustaining electrode lines Z1 to Zm and address electrode lines X1 to Xn. The scanning/sustaining electrode lines Y1 to Ym are sequentially driven while the common sustaining electrode lines Z1 to Zm are commonly driven. The address electrode lines X1 to Xn are divided into odd-numbered lines and even-numbered lines for a driving.

Such a three-electrode, AC surface discharge PDP fails to utilize a space of the discharge cell sufficiently because a sustaining discharge between the scanning/sustaining electrode 12Y and the common sustaining electrode occurs at the center portion of the discharge cell. Accordingly, it has a problem in that brightness of the discharge cell is lowered and emission efficiency is deteriorated.

In order to solve this problem, there has been suggested a scheme of installing the scanning/sustaining electrode 12Y and the common sustaining electrode 12Z causing a sustaining electrode at each boundary portion of the discharge cell or enlarging a width of the discharge electrode. However, as a distance between the scanning/sustaining electrode 12Y and the common sustaining electrode 12Z. increases, a discharge voltage also increases. Also, as a width of the discharge electrode is increased, a discharge current is also increased. Accordingly, the conventional three-electrode, AC surface discharge PDP has the disadvantage of large power consumption.

SUMMARY OF THE INVENTION

Accordingly, it is an object of the present invention to provide a plasma display panel and a driving method thereof that is adaptive for realizing a high efficiency.

In order to achieve these and other objects of the invention, a plasma display panel according to one aspect of the present invention includes a sustaining electrode pair and an address electrode included in each discharge cell; a first dielectric layer covering the sustaining electrode pair; a floating electrode pair formed on the first dielectric layer in parallel with the sustaining electrode pair to induce a discharge of the sustaining electrode pair; and a second dielectric layer and a protective film covering the floating electrode pair.

In the plasma display panel, one side of the floating electrode pair is overlapped with the sustaining electrode pair in the longitudinal direction.

Each electrode width of the floating electrode pair is greater than the width of the sustaining electrode pair.

An electrode distance between the floating electrode pair is smaller than an electrode distance between the sustaining electrode pair.

Each electrode of the floating electrode pair is provided with at least one hole having a desired size in every discharge cell. The hole is formed in such a manner so as not to be overlapped with the sustaining electrode pair.

A method of driving a plasma display panel according to another aspect of the present invention includes the steps of applying a voltage sequentially for each two scanning lines in a sustaining interval and driving said voltage into a floating electrode pair arranged between said two scanning lines, thereby generating an auxiliary discharge between the floating electrode pair; and generating a sustaining discharge sequentially at said two scanning lines using the auxiliary discharge.

In the described method, one side of the floating electrode pair is overlapped with the sustaining electrode pair in the longitudinal direction and has greater electrode widths than the sustaining electrode pair, thereby driving electric charges into the sustaining electrode pair.

An electrode distance of the floating electrode pair is smaller than the distance of the sustaining electrode pair, thereby generating a primary discharge of the floating electrode pair prior to a discharge of the sustaining electrode pair.

Each electrode of the floating electrode pair is provided with at least one hole having a desired size at every discharge cell to concentrate wall charges on opposite sides of the floating electrode pair.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
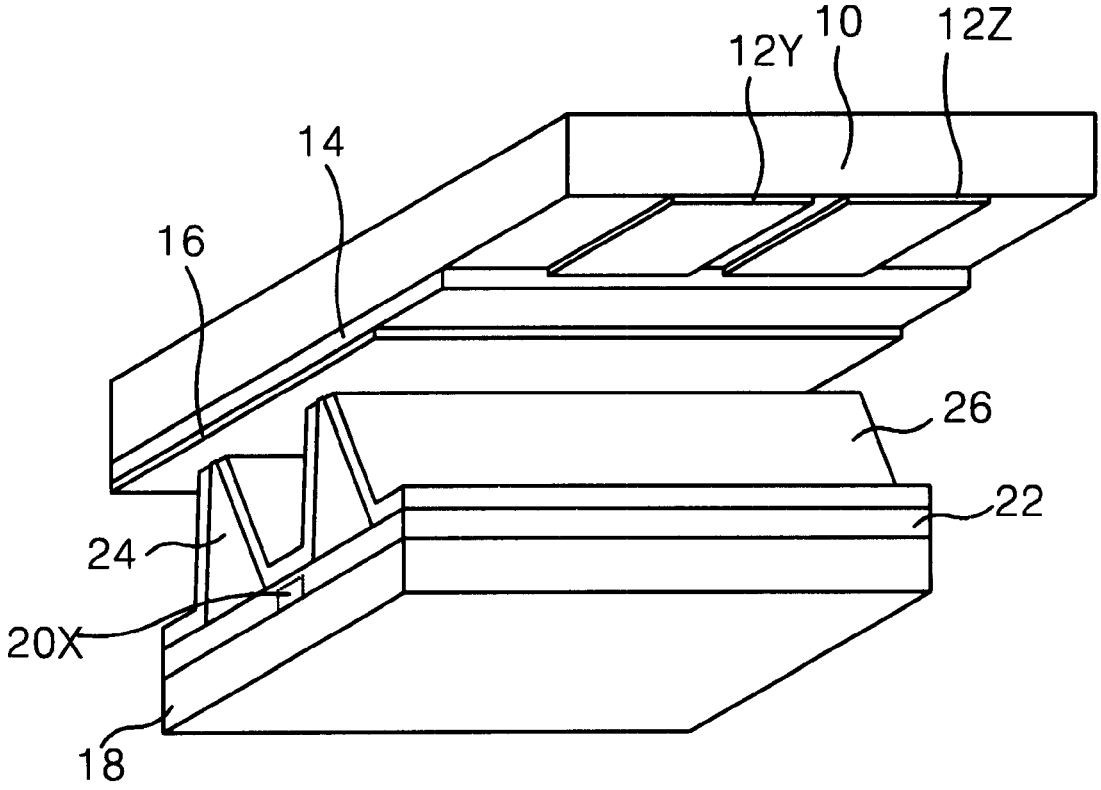
FIG. 1 CONVENTIONAL ART
FIG. 1 is a perspective view showing a discharge cell structure of a conventional three-electrode, AC surface discharge plasma display panel.
Figure 2:
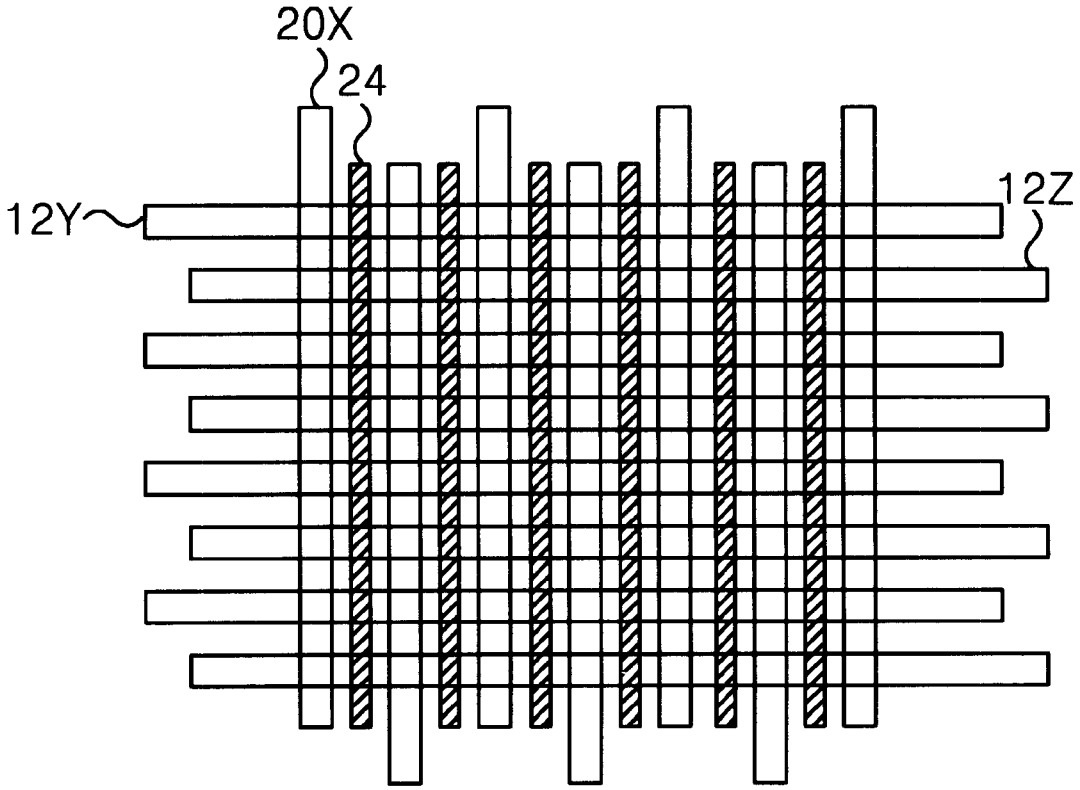
FIG. 2 CONVENTIONAL ART
FIG. 2 is a plan view of a plasma display panel including the discharge cells shown in FIG. 1.
Figure 3:
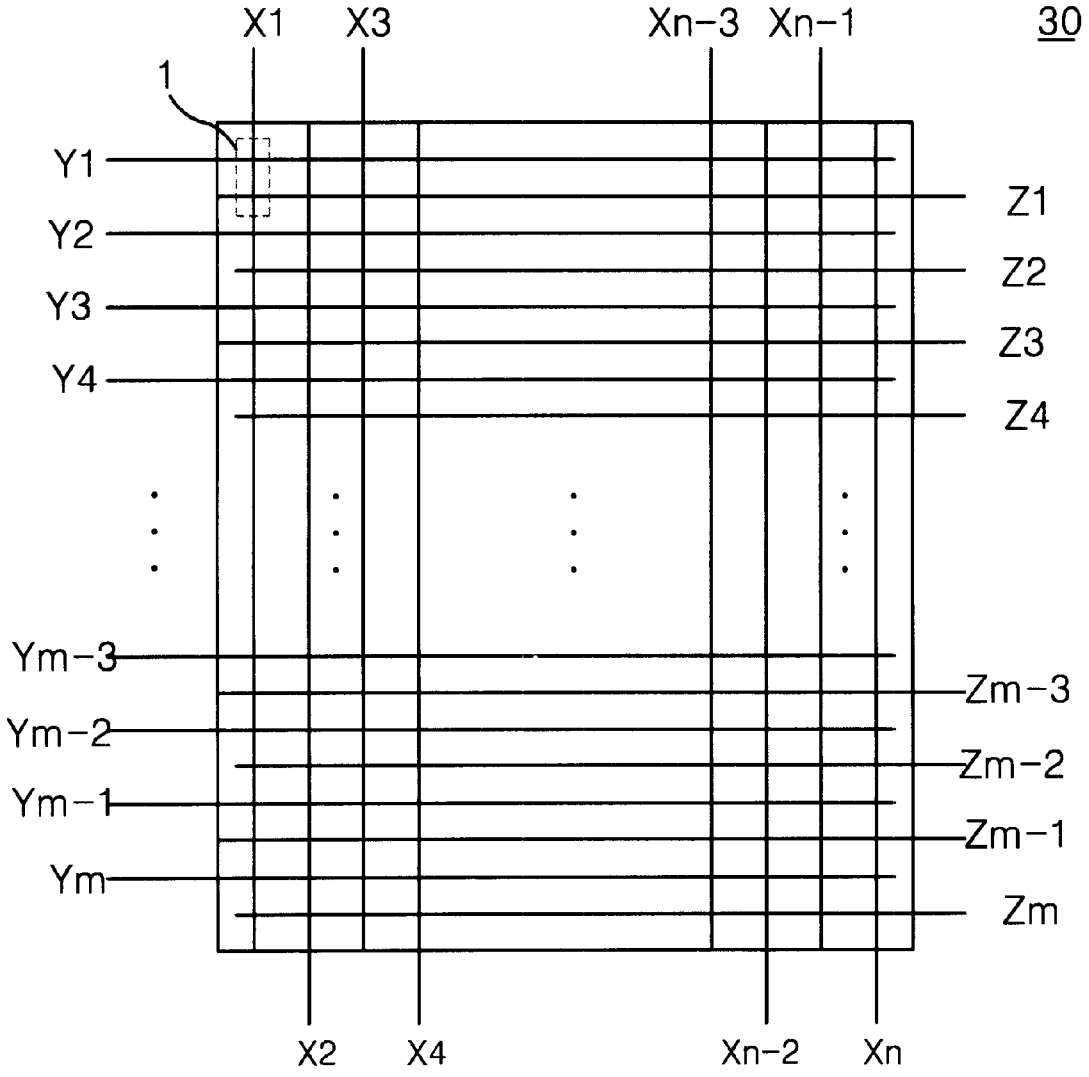
FIG.3 CONVENTIONAL ART
FIG. 3 illustrates an entire electrode arrangement of a plasma display panel including the discharge cells shown in FIG. 1.
Figure 4:
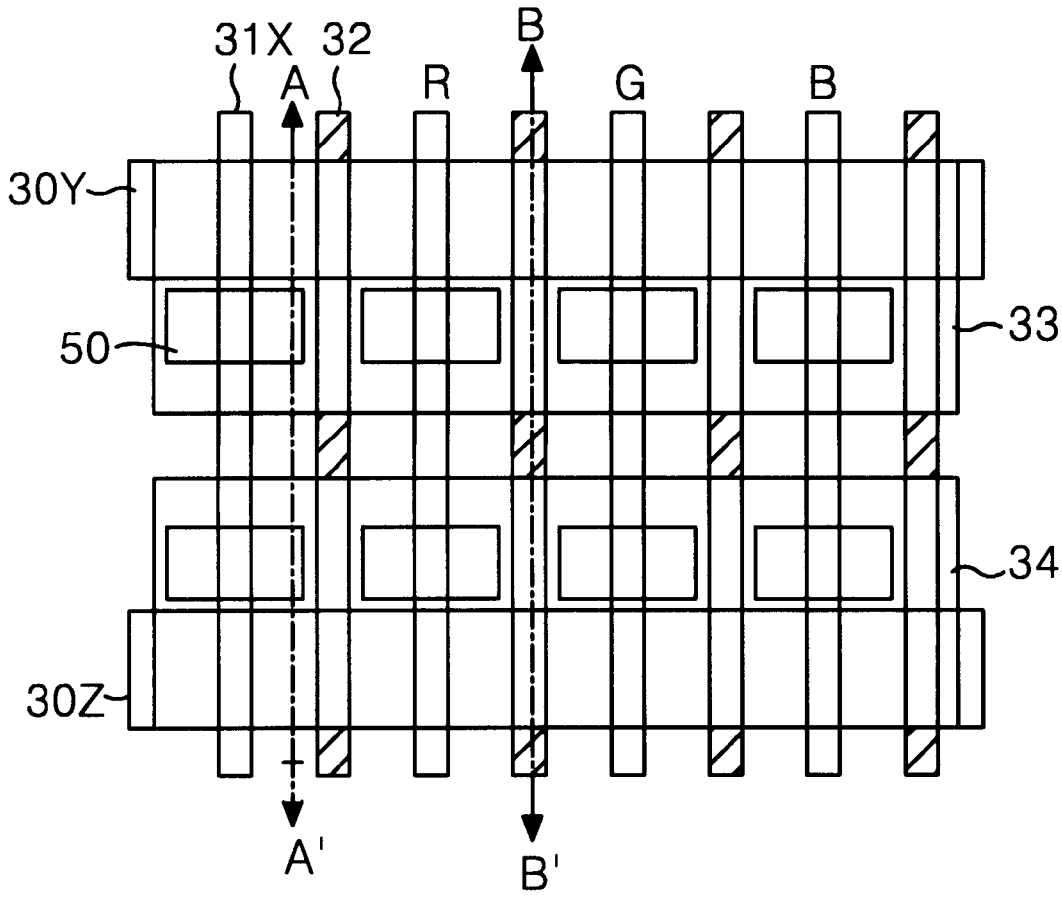
FIG. 4 is a plan view showing a structure of a plasma display panel according to an embodiment of the present invention.
Figure 5:
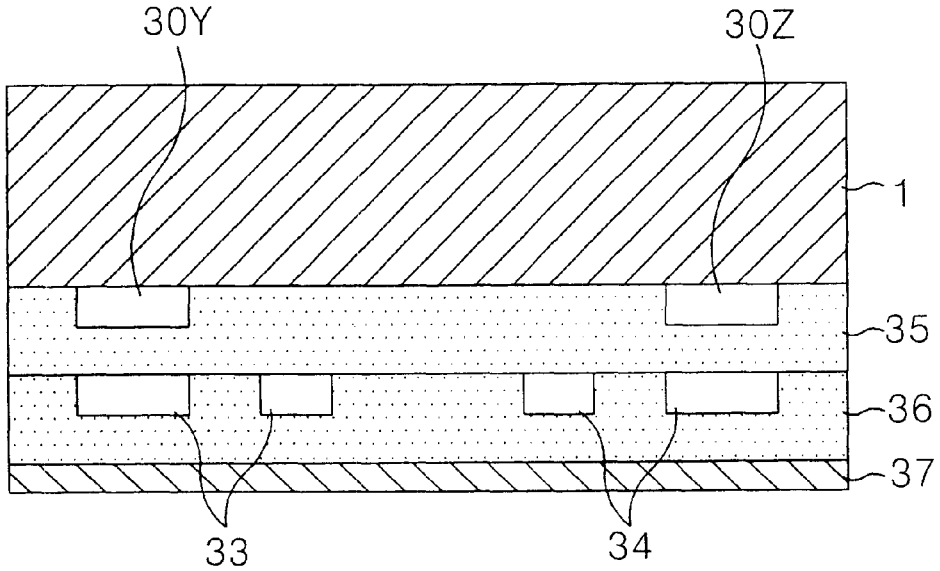
FIG. 5 is a section view of an upper substrate of the plasma display panel taken along the line A–A' in FIG. 4.
Figure 6:
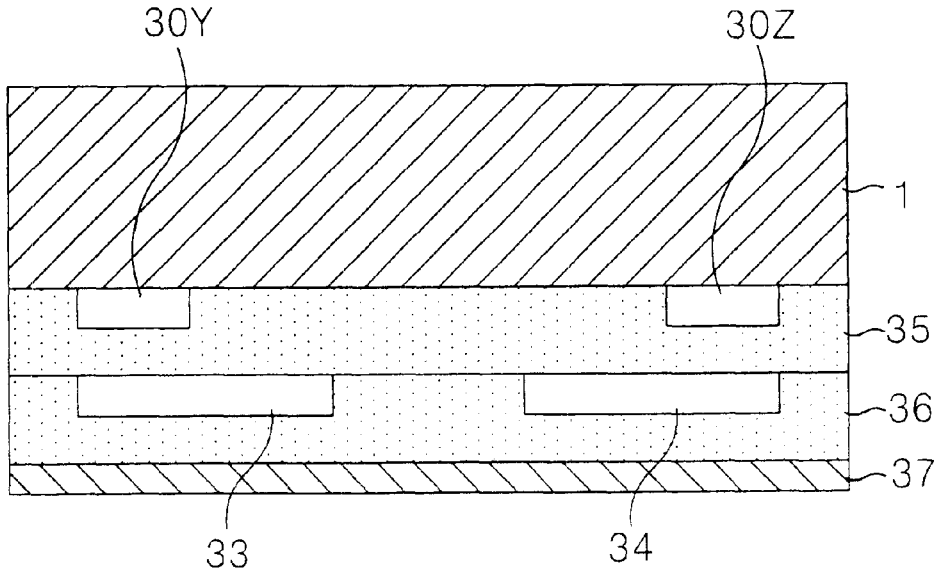
FIG. 6 is a section view of an upper plate of the plasma display panel taken along the line B–B' in FIG. 4.

FIG. 4 is a plan view showing a structure of a plasma display panel according to an embodiment of the present invention, FIG. 5 is a section view of an upper substrate of the plasma display panel taken along the line A–A' in FIG. 4, and FIG. 6 is a section view of an upper plate of the plasma display panel taken along the line B–B' in FIG. 4.

Referring to FIG. 4, FIG. 5 and FIG. 6, the upper substrate 1 of the plasma display panel includes a scanning/sustaining electrode 30Y and a common sustaining electrode 30Z, a first dielectric layer 35 provided on the upper substrate 1 in which the scanning/sustaining electrode 30Y and the common sustaining electrode 30Z are formed in parallel, first and second floating electrodes 33 and 34 deposited onto the first dielectric layer 35 and being subject to a two-divisional patterning via a photo mask, and a second dielectric layer 36 and a protective film 37 deposited onto the first dielectric layer 35 provided with the first floating electrode 33 and the second floating electrode 34.

The first floating electrode 33 is extended in a direction parallel to the adjacent scanning/sustaining electrode 30Y and is provided with a hole 50 defined between the adjacent barrier ribs 32. The second floating electrode 34 is extended in a direction parallel to the adjacent common sustaining electrode 30Z and is provided with a hole 50 defined between the adjacent barrier ribs 32. A distance between the first floating electrode 33 and the second floating electrode 34 is narrower than a distance between the scanning/sustaining electrode 30Y and the common sustaining electrode 30Z. One side of the first floating electrode 33 is overlapped with the scanning/sustaining electrode 30Y in the longitudinal direction while one side of the second floating electrode 34 is overlapped with the common sustaining electrode 30Z in the longitudinal direction.

Each of the scanning/sustaining electrode 30Y and the common sustaining electrode 30Z consists of a transparent electrode (not shown) made from a transparent electrode material such as indium-tin-oxide (ITO) so as to transmit a visible light, a bus electrode (not shown) made from a metal material so as to reduce a resistance component of the transparent electrode, and a pad electrode (not shown) for electrically connecting the transparent electrode to the bus electrode. The scanning/sustaining electrode 30Y and the common sustaining electrode 30Z are far away from each other so as to induce a long-path discharge, whereas the first floating electrode 33 and the second floating electrode 34 are not far away from each other. This drives a voltage into the first and second floating electrodes 33 and 34 when a voltage is applied to the scanning/sustaining electrode 30Y and the common sustaining electrode 30Z. Thus, a primary discharge is induced between the first floating electrode 33 and the second floating electrode 34 even at a low voltage. Due to such a priming effect, a discharge is induced between the scanning/sustaining electrode 30Y and the common sustaining electrode 30Z even upon application of a low voltage.

As shown in FIG. 4 and FIG. 5, each of the first floating electrode 33 and the second floating electrode 34 is provided with at least one hole 50 having a desired size at every discharge cell. Further, the first and second floating electrodes 33 and 34 have larger electrode widths than the sustaining electrode pair 30Y and 30Z. This arrangement is for driving a large amount of electric charges into the sustaining electrode pair 30Y and 30Z and for forming a large amount of wall charges at the opposite side surfaces of the first floating electrode 33 and the second floating electrode 34, thereby maximizing the priming effect. Such a maximization of the priming effect can lower a voltage applied to the scanning/sustaining electrode 30Y and the-common sustaining electrode 30Z.

The second dielectric layer 36 covers the floating electrode pair 33 and 34 so as to protect the floating electrode pair 33 and 34 and accumulate wall charges created upon plasma discharge. The protective film 37 prevents damage of the second dielectric layer 36 caused by sputtering occurring upon plasma discharge and enhances an emission efficiency of secondary electrons. The protective film 37 is usually made from magnesium oxide (MgO).

As described above, according to the present invention, two auxiliary electrodes (floating electrode pairs) are provided between the scanning/sustaining electrode and the common sustaining electrode to derive a voltage into said two auxiliary electrodes when a voltage is applied to the scanning/sustaining electrode and the common sustaining electrode, so that a primary discharge is induced between said two auxiliary electrodes at a low voltage and thus a long-path discharge is induced between the scanning/sustaining electrode and the common sustaining electrode spaced at a large distance from each other by a low voltage. Accordingly, it becomes possible to obtain a high efficiency of discharge.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel including a plurality of scanning lines and a plurality of discharge cells, comprising:

a sustaining electrode pair and an address electrode included in each of the discharge cells;

a first dielectric layer covering the sustaining electrode pair;

a floating electrode pair formed on the first dielectric layer in parallel to the sustaining electrode pair to induce a discharge of the sustaining electrode pair; and a second dielectric layer and a protective film covering the floating electrode pair.

2. The plasma display panel as claimed in claim 1, wherein one side of the floating electrode pair is overlapped with the sustaining electrode pair in the longitudinal direction.

3. The plasma display panel as claimed in claim 1, wherein each electrode width of the floating electrode pair is larger than that of the sustaining electrode pair.

4. The plasma display panel as claimed in claim 1, wherein an electrode distance between the floating electrode pair is smaller than an electrode distance between the sustaining electrode pair.

5. The plasma display panel as claimed in claim 1, wherein each electrode of the floating electrode pair is provided with at least one hole having a desired size every discharge cell.

6. The plasma display panel as claimed in claim 5, wherein the hole is formed in such a manner to be not overlapped with the sustaining electrode pair.

7. A method of driving a plasma display panel including a plurality of discharge cells for displaying a picture by a discharge and a plurality of scanning lines scanned at a certain scanning sequence, said method comprising the steps of:

applying a voltage sequentially to a sustaining electrode pair corresponding to each two scanning lines of the plurality of scanning lines in a sustaining interval and driving said voltage into a floating electrode pair arranged between said two scanning lines, thereby generating an auxiliary discharge between the floating electrode pair; and generating a sustaining discharge sequentially at said two scanning lines using the auxiliary discharge.

8. The method as claimed in claim 7, wherein one side of the floating electrode pair is overlapped with the sustaining electrode pair in the longitudinal direction and has greater electrode widths than the widths of the sustaining electrode pair, thereby driving electric charges into the sustaining electrode pair.

9. The method as claimed in claim 7, wherein an electrode rod distance between the floating electrode pair is less than the distance between the sustaining electrode pair, thereby generating a primary discharge of the floating electrode pair prior to a discharge of the sustaining electrode pair.

10. The method as claimed in claim 7, wherein each electrode of the floating electrode pair is provided with at least one hole having a desired size at every discharge cell to concentrate wall charges on the opposite sides of the floating electrode pair.

* * * * *